US005515684A

United States Patent [19]

Lucas et al.

[11] Patent Number: 5,515,684

[45] Date of Patent: May 14, 1996

[54] RESONANT MACROSONIC SYNTHESIS

[75] Inventors: Timothy S. Lucas, Richmond; Thomas W. Van Doren, Fredericksburg, both of Va.

[73] Assignee: Macrosonix Corporation, Richmond, Va.

[21] Appl. No.: 310,786

[22] Filed: Sep. 27, 1994

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS 5,319,938 6/1994 Lucas ..... 62/6

OTHER PUBLICATIONS

Gaitan et al, "Finite Amplitude Standing Waves in Harmonic and Anharmonic Tubes" J. Acoust. Soc. Am. May 5, 1993 pp. 2489–2495.

Blackstock "Finite-Amplitude Motion of a Piston in a Shallow, Fluid-Filled Cavity", The Journal of the Acoustical Society of America, vol. 34, No. 6, Jun. 1962, pp. 796–802.

*Primary Examiner*—Ronald C. Capossela

*Attorney, Agent, or Firm*—Foley & Lardner

[57] ABSTRACT

An acoustic resonator includes a chamber containing a fluid. The chamber has anharmonic resonant modes and provides boundary conditions which predetermine the harmonic phases and amplitudes needed to synthesize a non-sinusoidal, unshocked waveform.

29 Claims, 15 Drawing Sheets

RESONATOR 22

| | THEORY | EXPERIMENT |
|---|---|---|
| POWER (WATTS) | 60.72 | 66.90 |

| | PRESSURE AT z=0 (PSI) | |
|---|---|---|
| | THEORY | EXPERIMENT |
| FUNDAMENTAL | 75.30 ∠ 90° | 75.30 ∠ 90° |
| 2nd HARMONIC | 23.85 ∠ 90° | 29.20 ∠ 90° |
| 3rd HARMONIC | 11.94 ∠ 90° | 12.60 ∠ 90° |

| | HARMONIC (Hz) | MODE (Hz) |
|---|---|---|
| 1 | 618.5 | 618.5 |
| 2 | 1237.0 | 1071.1 |
| 3 | 1855.5 | 1524.1 |
| 4 | | 1981.2 |

RESONATOR 34

| | THEORY | EXPERIMENT |
|---|---|---|
| POWER (WATTS) | 44.28 | 44.83 |

PRESSURE AT z=0 (PSI

| | THEORY | EXPERIMENT |
|---|---|---|
| FUNDAMENTAL | 88.02 ∠ 90° | 88.02 ∠ 90° |
| 2nd HARMONIC | 19.34 ∠ 90° | 18.88 ∠ 90° |
| 3rd HARMONIC | 8.65 ∠ 90° | 10.01 ∠ 90° |

| | HARMONIC (Hz) | MODE (Hz) |
|---|---|---|
| 1 | 679.3 | 679.3 |
| 2 | 1358.7 | 1062.5 |
| 3 | 2038.0 | 1455.4 |
| 4 | | 1918.3 |
| 5 | | 2388.9 |

RESONATOR 50

| | THEORY |
|---|---|
| POWER (WATTS | 18.09 |

| | PRESSURE AT z=0 (PSI) THEORY |
|---|---|
| FUNDAMENTAL | 20.0 ∠ -90° |
| 2nd HARMONIC | 4.45 ∠ -90° |
| 3rd HARMONIC | 6.81 ∠ -90° |

| | Harmonic (Hz) | Mode (Hz) |
|---|---|---|
| 1 | 328.7 | 328.7 |
| 2 | 657.3 | 685.5 |
| 3 | 986.0 | 1011.5 |

RESONATOR 62

| | THEORY | EXPERIMENT |
|---|---|---|
| POWER (WATTS | 18.94 | 21.40 |

PRESSURE AT z=0 (PSI

| | THEORY | EXPERIMENT |
|---|---|---|
| FUNDAMENTAL | 54.40 ∠ -90° | 54.40 ∠ -90° |
| 2nd HARMONIC | 3.48 ∠ -90° | 6.96 ∠ -90° |
| 3rd HARMONIC | 5.98 ∠ 90° | 2.50 ∠ 90° |

| | HARMONIC (Hz) | MODE (Hz) |
|---|---|---|
| 1 | 574.4 | 574.4 |
| 2 | 1148.7 | 802.4 |
| 3 | 1723.1 | 1047.2 |
| 4 | | 1383.8 |
| 5 | | 1684.7 |
| 6 | | 2011.7 |

RESONANT MACROSONIC SYNTHESIS

BACKGROUND OF THE INVENTION

1) Field of Invention

This invention relates to acoustic resonators which are designed to provide the specific harmonic phases and amplitudes required to predetermine the waveform of extremely large acoustic pressure oscillations, having specific applications to acoustic compressors.

2) Description of Related Art

It is well known in the field of acoustics that when acoustic pressure amplitudes are finite compared to the medium's undisturbed ambient pressure, the resulting nonlinear effects will generate sound waves at harmonics of the fundamental frequency. We will hereafter refer to these nonlinearly generated sound waves as harmonics.

For both traveling and standing waves, the presence of high amplitude harmonics is associated with the formation of shock waves, which severely limit a wave's peak-to-peak pressure amplitude. Shock formation requires harmonic amplitudes that are significant relative to the amplitude of the sound wave at the fundamental frequency. We will hereafter refer to these as high relative amplitude harmonics.

For finite amplitude traveling waves, the harmonic relative amplitudes will depend primarily on the nonlinear properties of the medium. For finite amplitude standing waves occurring in a resonant cavity the harmonic relative amplitudes will likewise depend on the medium, but also are strongly influenced by the resonator's boundary conditions. The boundary conditions of the resonator are determined by the geometry of the walls and by the acoustical properties of the wall material and the fluid in the resonator.

As explained in U.S. Pat. No. 5,319,938, acoustic resonators can now be designed which provide very large and nearly sinusoidal pressure oscillations. FIG. 1 shows the waveform of a sinusoidal pressure wave. A sinusoidal wave is pressure symmetric implying that $|P_+|=|P_-|$, where $P_+$ and $P_-$ are the maximum positive and negative pressure amplitudes respectively. If a sinusoidal pressure oscillation is generated in a resonator having an ambient pressure $P_0$, then $(P_0+|P_+|)$ cannot exceed $2P_0$, since otherwise the pressure symmetry would require that $(P_0-|P_-|)$ be less than zero absolute, which is impossible. Thus, the maximum peak-to-peak pressure a sinusoidal oscillation can provide is $2P_0$. This ignores any changes in the ambient pressure caused by nonlinear processes driven by the acoustic pressures.

The '938 patent provides shock-free waves by preventing formation of high relative amplitude harmonics. However, there are acoustic resonator applications where the resulting sinusoidal waveforms present a limitation. For example, resonators used in acoustic compressors must at times provide compressions requiring $P_+$ to be larger than $P_0$ by a factor of 3 or more. An acoustic compressor used in low-temperature Rankine-cycle applications may require $P_+$ to exceed 215 psia for a $P_0$ of only 70 psia. The acoustic wave needed to fit these conditions would require an extreme pressure asymmetry (about the ambient pressure $P_0$) between $P_-$ and $P_+$.

Previously, the generation of resonant pressure-asymmetric waves presented specific unsolved problems. For a waveform to deviate significantly from a sinusoid, it must contain high relative amplitude harmonics. These harmonics would normally be expected to lead to shock formation, which can critically limit peak-to-peak pressure amplitudes as well as cause excessive energy dissipation.

Resonant acoustic waves have been studied theoretically and experimentally. With respect to the present invention, these studies can be grouped into two categories: (i) harmonic resonators driven off-resonance, and (ii) anharmonic resonators driven on-resonance.

A resonator is defined as "harmonic" when it has a set of standing wave mode frequencies that are integer multiples of another resonance frequency. For the following discussions only longitudinal resonant modes are considered. Harmonically tuned resonators produce shock waves if finite amplitude acoustic waves are excited at a resonance frequency. For this reason harmonic resonator studies which examine non-sinusoidal, non-shocked waveforms focus primarily on waveforms produced at frequencies off-resonance. Driving a resonator off-resonance severely limits the peak-to-peak pressure amplitudes attainable.

The following references are representative of the harmonic resonator studies: (W. Chester, "Resonant oscillations in closed tubes," *J. Fluid Mech.* 18, 44–64 (1964)), (A. P. Coppens and J. V. Sanders, "Finite-amplitude standing waves in rigid-walled tubes," *J. Acoust. Soc. Am.* 43, 516–529 (1968)), (D. B. Cruikshank, Jr., "Experimental investigations of finite-amplitude acoustic oscillations in a closed tube," *J. Acoust Soc. Am.* 43, 1024–1036 (1972)) and (P. Merkli, H. Thoman, "Thermoacoustic effects in a resonance tube," *J. Fluid Mech.* 70, 1161–177 (1975))

A resonator is defined as "anharmonic" when its does not have a set of standing wave mode frequencies that are integer multiples of another resonance frequency. Studies of anharmonic resonators driven on-resonance are usually motivated by applications in which the elimination of high relative amplitude harmonics is necessary. For example, thermoacoustic engine resonators require high amplitude sine waves, and thus are designed for the greatest possible reduction of harmonic amplitudes. An example of such a study can be found in the work of D. Felipe Gaitan and Anthony A. Atchley (D. F. Gaitan and A. A. Atchley, "Finite amplitude standing waves in harmonic and anharmonic tubes," *J. Acoust. Soc. Am.* 93,2489–2495 (1993)).

Gaitan and Atchley provide anharmonic resonators by using geometries with sections of different diameter. The area changes occurred over a distance that was small compared to the length of the resonator. As explained in U.S. Pat. No. 5,319,938 this approach tends to provide significant suppression of the wave's harmonics, thus providing sinusoidal waveforms.

In summary, those resonators driven on-resonance at finite amplitudes either produced sinusoidal waves or shock waves. Resonators driven off-resonance resulted in very low peak-to-peak pressure amplitudes.

The ability to provide high peak-to-peak pressure amplitude, non-sinusoidal, unshocked waves of a desired waveform would represent a significant advance for high compression acoustic resonators. Such waveforms require high relative amplitude harmonics to exist when the resonator is excited at a resonant frequency.

Consequently, there exists a need for resonators that can synthesize unshocked waveforms at high pressure amplitudes.

SUMMARY OF THE INVENTION

It is an object of the present invention to provide acoustic resonators whose boundary conditions maintain the predetermined harmonic phases and amplitudes needed to synthesize a desired waveform.

A further object of the present invention is to provide acoustic resonators whose boundary conditions are designed to exploit the relative phases of harmonics as a means to dramatically extend the pressure amplitude shock-limit normally associated with high relative amplitude harmonics.

A still further object of the present invention is to provide extremely high-amplitude pressure-asymmetric waves at resonance.

The acoustic resonator of the present invention includes a chamber containing a fluid. A chamber's geometry, as well as the acoustic properties of the chamber wall material and the fluid, creates the boundary conditions needed to produce the harmonic phases and amplitudes of a predetermined waveform. The chambers have a continuously varying cross-sectional area in order to avoid turbulence due to high acoustic particle velocities, and in order to allow high relative amplitude harmonics.

The acoustic resonators of the invention can be used in acoustic compressors to provide large compressions for various applications, such as heat exchange systems.

As described above, the acoustic resonators of the present invention provide a number of advantages and can achieve peak-to-peak acoustic pressure amplitudes which are many times higher than the medium's ambient pressure. In particular, it is a surprising advantage that these extremely high amplitude pressure oscillations, which have precisely controlled waveforms, can be provided with very simple resonator geometries.

These and other objects and advantages of the invention will become apparent from the accompanying specifications and drawings, wherein like reference numerals refer to like parts throughout.

DETAILED DESCRIPTION OF THE PREFERRED EMBODIMENTS

Anharmonic resonators having localized impedance changes

Figure 5:
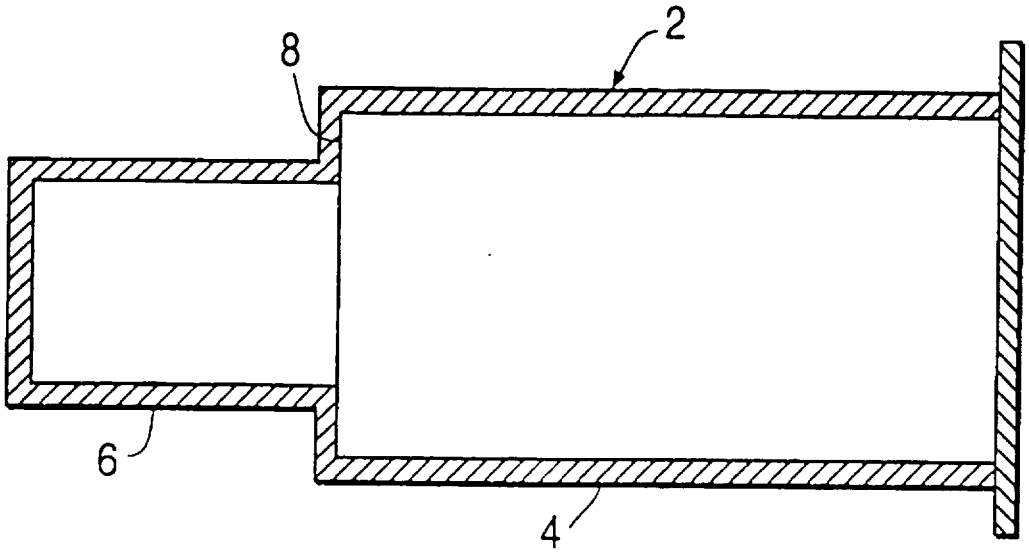
FIG. 5 PRIOR ART
FIG. 5 is a sectional view of a resonator which provides a stepped impedance change.

As described in U.S. Pat. No. 5,319,938, anharmonic resonators with abrupt changes in cross sectional area will significantly reduce the relative amplitudes of the harmonics. These abrupt changes in area introduce a localized acoustic impedance change within the resonator. An example of an abrupt impedance change is shown in FIG. 5, where a resonator 2 is formed by joining a large diameter section 4 to a small diameter section 6. This abrupt change in cross sectional area creates an impedance step 8, which is highly localized with respect to the resonator's length.

Since localized impedance change (LI hereafter means Localized Impedance change) resonators tend to maintain harmonics at low relative amplitude, the waveform remains substantially sinusoidal.

Anharmonic resonators having distributed impedance changes

The preferred embodiment of the present invention includes a resonator having a distributed impedance change (DI hereafter means Distributed Impedance change). Unlike LI resonators, DI resonators can easily allow high relative amplitude harmonics to exist.

Figure 6:
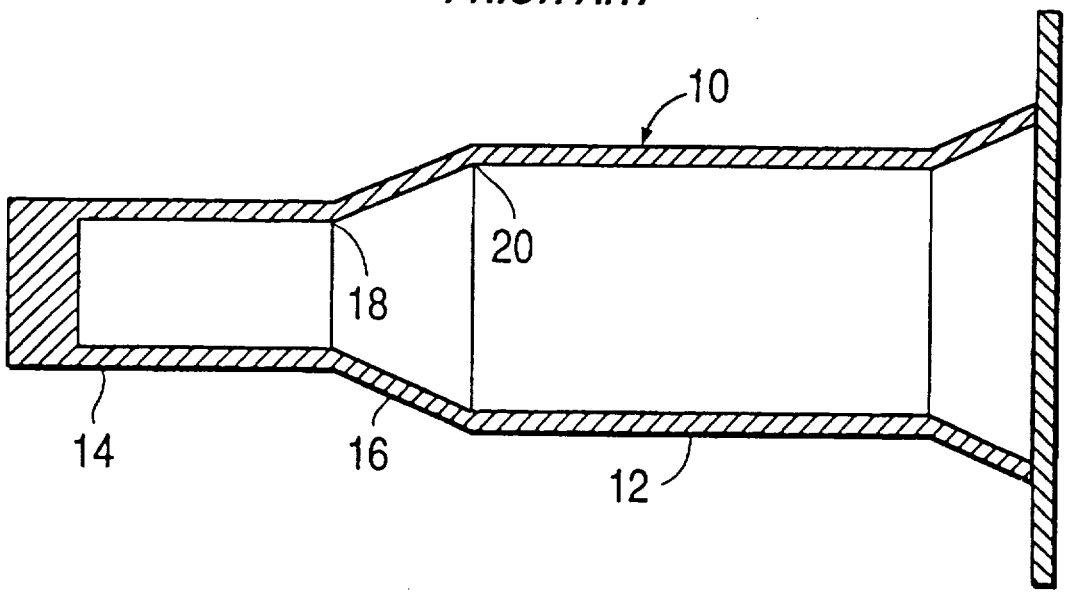
FIG. 6 PRIOR ART
FIG. 6 is a sectional view of a resonator which provides a partially distributed impedance change.

The resonators shown in FIGS. 5, 6, 7, 9, 11 and 13 illustrate the differences between LI and DI resonators. FIG. 6 shows a resonator 10 which is reproduced from FIG. 6 of U.S. Pat. No. 5,319,938. Resonator 10 includes conical section 16 which joins large diameter section 12 to small diameter section 14. Unlike the resonator of FIG. 5, this change in cross sectional area is not completely localized, but is partially distributed. This partially distributed area change results in a partially distributed impedance change, which occurs along the length of conical section 16.

Here, and throughout, the term partially distributed is used to imply less than the entire length of the resonator. The terms LI and DI are not used to imply a specific extent of distribution. For example, between the LI resonator of FIG. 5 and the fully DI resonators of FIGS. 7, 9, 11 and 13 there exists a continuum of partially DI resonators. Thus, the present invention's scope is not limited to a specific degree of distributed impedance. Conversely, the scope of the invention includes the employment of the specific distributed impedance required by a given application or desired waveform.

The resonators shown in FIGS. 7, 9, 11 and 13 provide embodiments of the present invention which avoid abrupt area changes in order to provide high amplitude harmonics. When compared at the same fundamental amplitude, the present invention's resonators can provide higher amplitude harmonics than the more abrupt area change resonators shown in FIGS. 5 and 6.

Due to their comparatively low relative amplitude harmonics, the resonators of FIGS. 5 and 6 would need much higher fundamental amplitudes to generate the relative harmonic amplitudes needed to cause an appreciable change in the waveform. However, the excessive turbulence caused by abrupt area changes makes higher fundamental amplitudes extremely difficult and inefficient to achieve.

For example, when the resonator of FIG. 6 has an average pressure $P_0$ of 85 psia and a peak-to-peak pressure amplitude of 60 psi, all harmonic amplitudes are at least 25 dB below the fundamental, resulting in a nearly sinusoidal waveform. At peak-to-peak pressures of 60 psi and above, turbulence begins to dominate the performance, as evidenced by high-amplitude high-frequency noise riding on the fundamental, and by excessive power consumption.

In order to avoid turbulence at the design conditions the preferred embodiment of the present invention includes resonators having a radius r and an axial coordinate z, where dr/dz is continuous wherever particle velocities are high enough so as to otherwise cause turbulence due to the discontinuity. The preferred embodiment also avoids excessive values of $d^2r/dz^2$ where particle velocities are high, in order to prevent turbulence which would otherwise occur as a result of excessive radial fluid accelerations.

Harmonic phase within harmonic resonators

In order to provide some helpful insight into the resonators of the present invention it is instructive to first examine the simpler case of harmonic resonators.

Within harmonic resonators, harmonic phases have a strong but predictable frequency dependence when the drive frequency is in the vicinity of a mode frequency, as shown in the literature (see for example, W. Chester, Resonant oscillations in closed tubes, J. Fluid Mech. 18, 44–64 (1964)).

Figure 1:
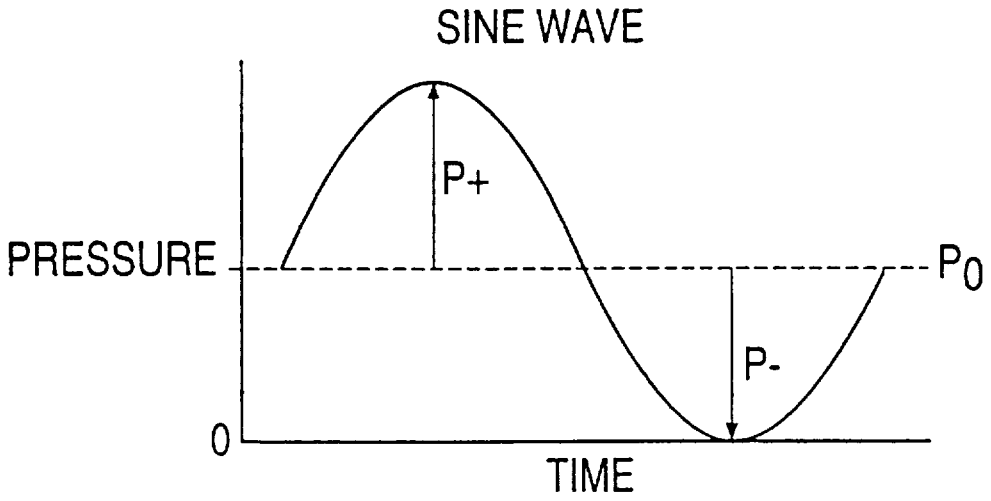
FIG. 1 is a graphical representation of the absolute peak-to-peak pressure amplitude limit for a sine wave.
Figure 2:
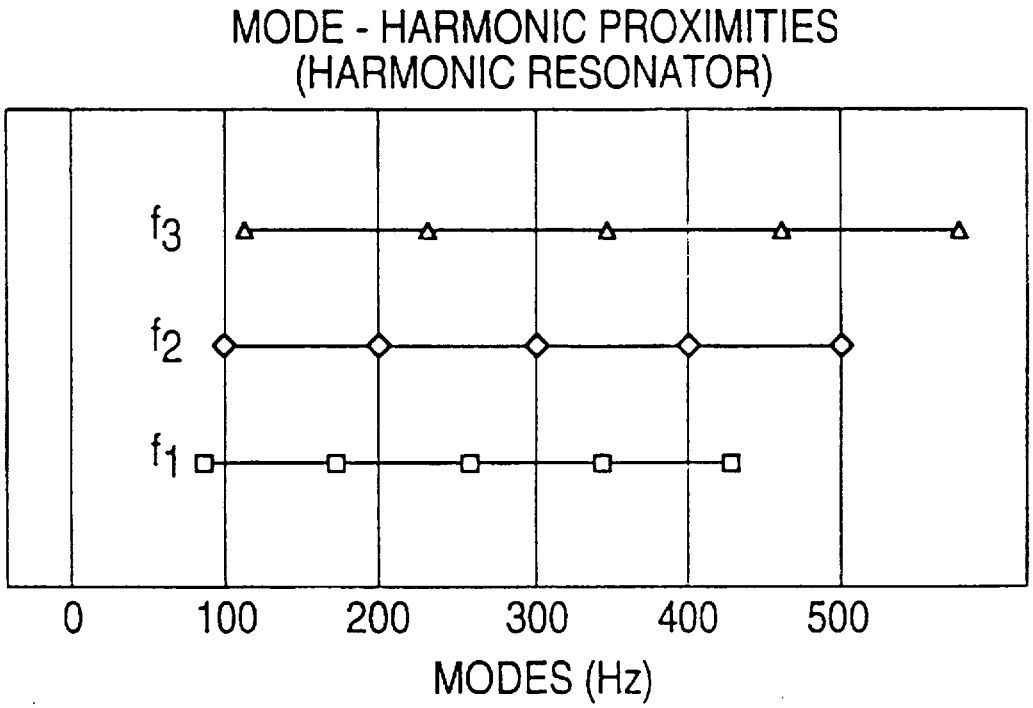
FIG. 2 is a graphical representation of the mode frequencies and harmonic frequencies for a harmonically tuned resonator.

These effects are considered for harmonics 1–5 as follows for the example of a harmonic resonator driven at frequencies very close to a mode frequency. FIG. 2 illustrates the case of a perfectly harmonic cylindrical resonator for three drive frequencies: $f_1$ below, $f_2$ equal to and $f_3$ above the resonance frequency of mode 1. The bottom horizontal axis indicates the resonance frequencies of the first five modes of the resonator (denoted by the vertical lines at 100, 200, 300, 400 and 500 Hz). The three horizontal lines with superposed symbols provide axes for the wave's fundamental and associated lower harmonics (denoted by the symbols) at drive frequencies $f_1$, $f_2$ and $f_3$.

The frequency-dependent harmonic phase relationships can be qualitatively demonstrated by the following:

where E(t) is the acoustic pressure(which adds to the ambient pressure $P_0$), $A_n$ is the amplitude of each harmonic n, f is the $$E(t) = \sum_{n=1}^{\infty} A_n \sin(n2\pi ft + \phi_n) \qquad \text{Equation 1}$$

fundamental (or drive) frequency of the acoustic wave and $\phi_n$ is the frequency-dependent phase of each harmonic n.

Figure 3:
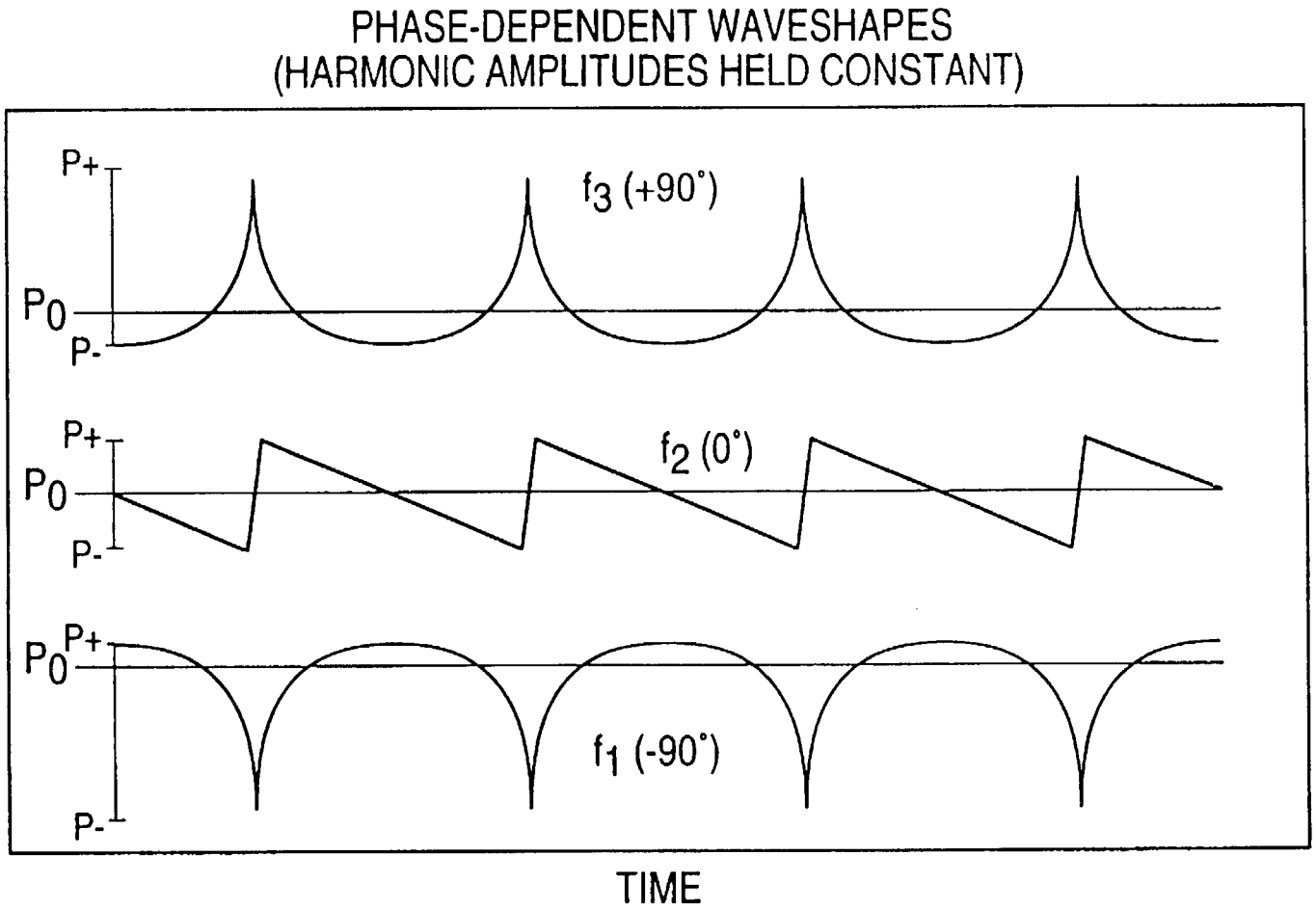
FIG. 3 is a graphical representation of the waveforms produced within a harmonically tuned resonator, when the drive frequency is varied about the fundamental resonance.

FIG. 3 provides the resulting waveforms, as measured at either end of the cylindrical resonator, for the three drive frequencies $f_1$, $f_2$ and $f_3$ of FIG. 2. All of the drive frequencies f are near the lowest resonance frequency of the resonator. For this example, the amplitudes of the fundamental and harmonics are given by $A_n=1/n$ for each of the three waveforms (note that this ignores any frequency dependence that $A_n$ may have). In FIG. 3, time is the horizontal axis and pressure is the vertical axis, where $P_0$ is the ambient pressure of the medium.

Referring to FIG. 2, drive frequency $f_1$ is below the mode 1 frequency, causing the frequency of harmonic n ($nf_1$) to fall between the frequencies of modes n−1 and n. The resulting fundamental and harmonic phases are $\phi_n=-90°$ for each n. The pressure waveform is calculated using Equation 1 and is denoted by $f_1$ in FIG. 3. This waveform is referred to as asymmetric negative (AN), since $|P_-|>|P_+|$.

Drive frequency $f_2$ in FIG. 2 is equal to the mode 1 frequency, causing the frequency of harmonic n to be equal to the frequency of mode n. The resulting fundamental and harmonic phases are $\phi_n=0°$ for each n. The pressure waveform is denoted by $f_2$ in FIG. 3, where the wave is shocked and $|P_+|=|P_-|$.

Drive frequency $f_3$ in FIG. 2 is greater than the mode 1 frequency but less than the mode 2 frequency, causing the frequency of harmonic n to fall between the frequencies of modes n and n+1. The resulting fundamental and harmonic phases are $\phi_n=90°$ for each n. The pressure waveform is denoted by $f_3$ in FIG. 3, and is referred to as asymmetric positive (AP), since $|P_+|>|P_-|$.

Figure 4A:
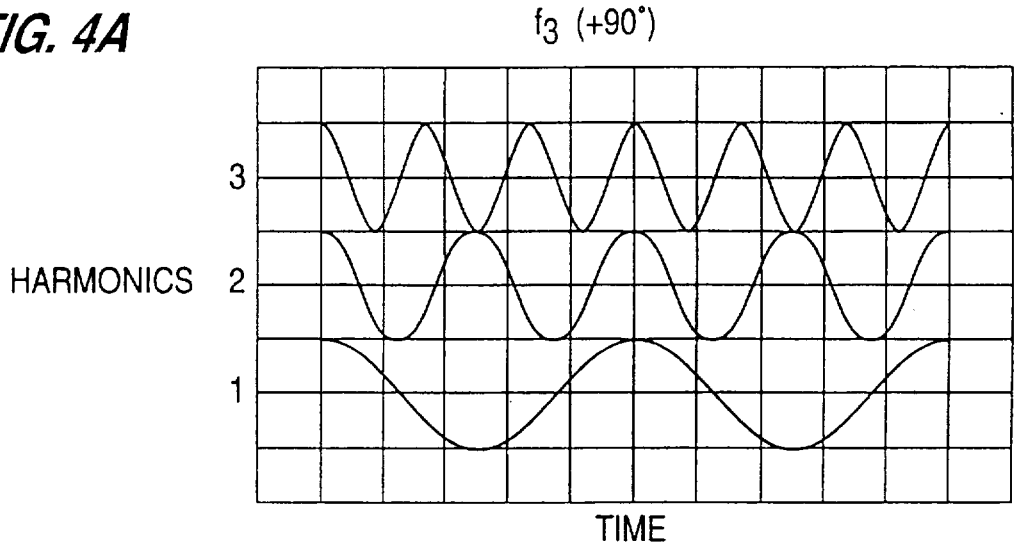
FIGS. 4A–4C is a graphical representation of the relative harmonic phases corresponding to the three waveforms shown in FIG. 3.
Figure 4B:
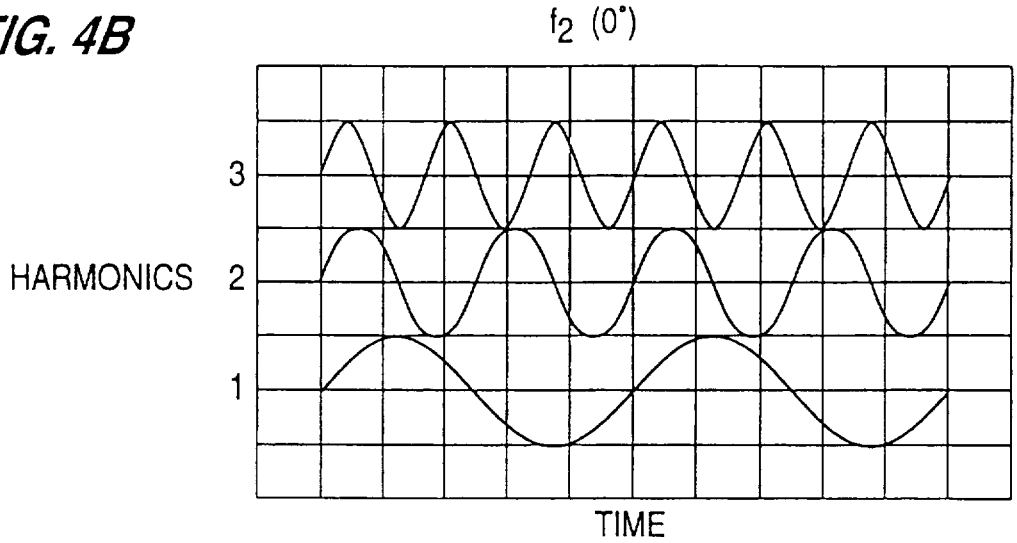
Figure 4C:
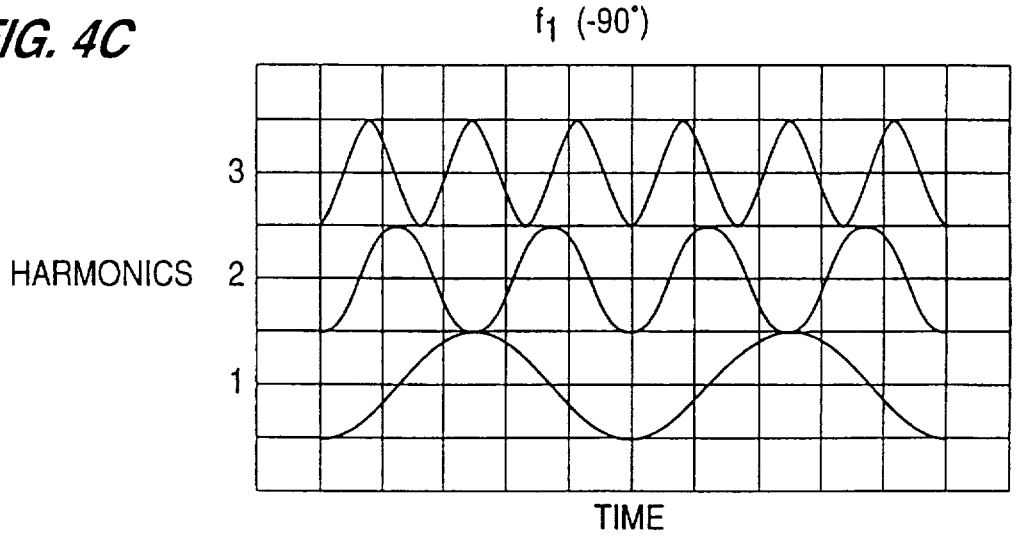

The relative phases of the first three harmonics (with frequencies f, 2f and 3f) for each waveform shown in FIG. 3 are demonstrated in FIGS. 4A–4C. Note that the amplitude of each harmonic has been normalized. For different phase angles $\phi_n$ the relative positions in time of each harmonic component of a wave change.

When the harmonic resonator's drive frequency is swept up through the lowest resonance frequency the phases $\phi_n$ sweep from −90° through 0° (at resonance) to +90° taking a continuum of values within the range. Note that as the drive frequency f is swept through the resonance frequency of mode n=1, each harmonic frequency nf will be swept through the resonance frequency of the nth mode. Phases $\phi_n$ between −90° and 0° will produce AN waves, and phases $\phi_n$ between 0° and +90° will produce AP waves. When $\phi_n=\pm 90°$ the waveforms will be symmetric in time like $f_1$ and $f_3$ of FIG. 3, and when $-90°<\phi_n<+90°$, the waveforms will be asymmetric in time. As the $\phi_n$ approach 0 from a value of ±90°, the waveforms become progressively more time asymmetric as they evolve towards a sawtooth waveform (i.e., a shockwave). For simplicity, nonlinear effects which cause the resonance frequencies to change (such as hardening or softening nonlinearities) are not considered in the previous example. Another effect that has been ignored is that, as the phases $\phi_n$ approach 0°, the relative amplitudes of the harmonics will increase.

The above example of the behavior of a harmonic resonator gives some insight into how pressure waveforms can be altered by changing the phases of the harmonics. The present invention exploits the phenomenon of variable harmonic phase in anharmonic resonators driven on resonance by altering the resonator's boundary conditions.

Phase determination in anharmonic resonators

In creating the resonator boundary conditions needed to control both harmonic phase and amplitude, the present invention provides a means to synthesize a desired waveform over a wide range of acoustic pressure amplitudes. This new capability is referred to as Resonant Macrosonic Synthesis (RMS).

The so-called pressure amplitude "shock-limit" is commonly associated with high relative amplitudes of the harmonics. RMS demonstrates that shock formation is more precisely a function of harmonic phase. The present invention exploits the ability to alter the phase of the harmonics, thereby dramatically extending the shock-limit to permit heretofore unachievable pressure amplitudes.

Some insight into the significance of phase variations can be gained in reference to FIGS. 3 and 4A–4C. The fundamental and harmonic amplitudes ($A_n$ of Equation 1) of $f_2$ and $f_3$ are the same. By changing only the harmonic phase, $f_2$ experiences a 30% increase in peak-to-peak pressure amplitude. In practice, the gain in the maximum possible pressure amplitude will be much greater. When the phases of the harmonics are changed from 0° to +90°, the classic shock is removed and the power once dissipated due to the shock front can contribute to much higher pressure amplitudes.

As shown in FIGS. 2, 3 and 4A–4C, the frequency dependence of the phases of the harmonics seen in harmonic resonators is predictable, and uniformly imparts a phase shift of like sign to the lower harmonics of the fundamental. This phase shift (and the resulting waveform change) occurs as the resonator is swept through resonance. The anharmonic resonators of the present invention are designed to give a desired waveform (determined by the harmonic amplitudes and phases) while running at a resonance frequency. Even though the mode-harmonic proximities of anharmonic resonators are fixed (while the drive frequency is kept equal to a resonance frequency), phase and amplitude effects similar to those of harmonic resonators still exist. These effects are exploited in the design of the boundary conditions (determined by the geometry of the walls and by the acoustical properties of the wall material and fluid in the resonator) of the present invention, whereby different phases and relative amplitudes can be imparted to individual harmonics as required for a desired waveform.

In the following embodiments, only the fundamental (of frequency f, where f is the drive frequency) and harmonics 2 (of frequency 2f) and 3 (of frequency 3f) are considered. The greater a harmonic's relative amplitude the greater its potential effect on the net waveform. The nonlinear processes through which energy is transferred to higher harmonics tend to result in harmonics that diminish in amplitude as the number of the harmonic rises. Thus, a fairly accurate representation of the final waveform can be achieved by considering the fundamental and harmonics 2 and 3. In practice, the same analytical methods used to determine the amplitude and phase of harmonics 2 and 3 can be extended to harmonics 4 and higher, in order to determine their impact on the net waveform.

Figure 15A:
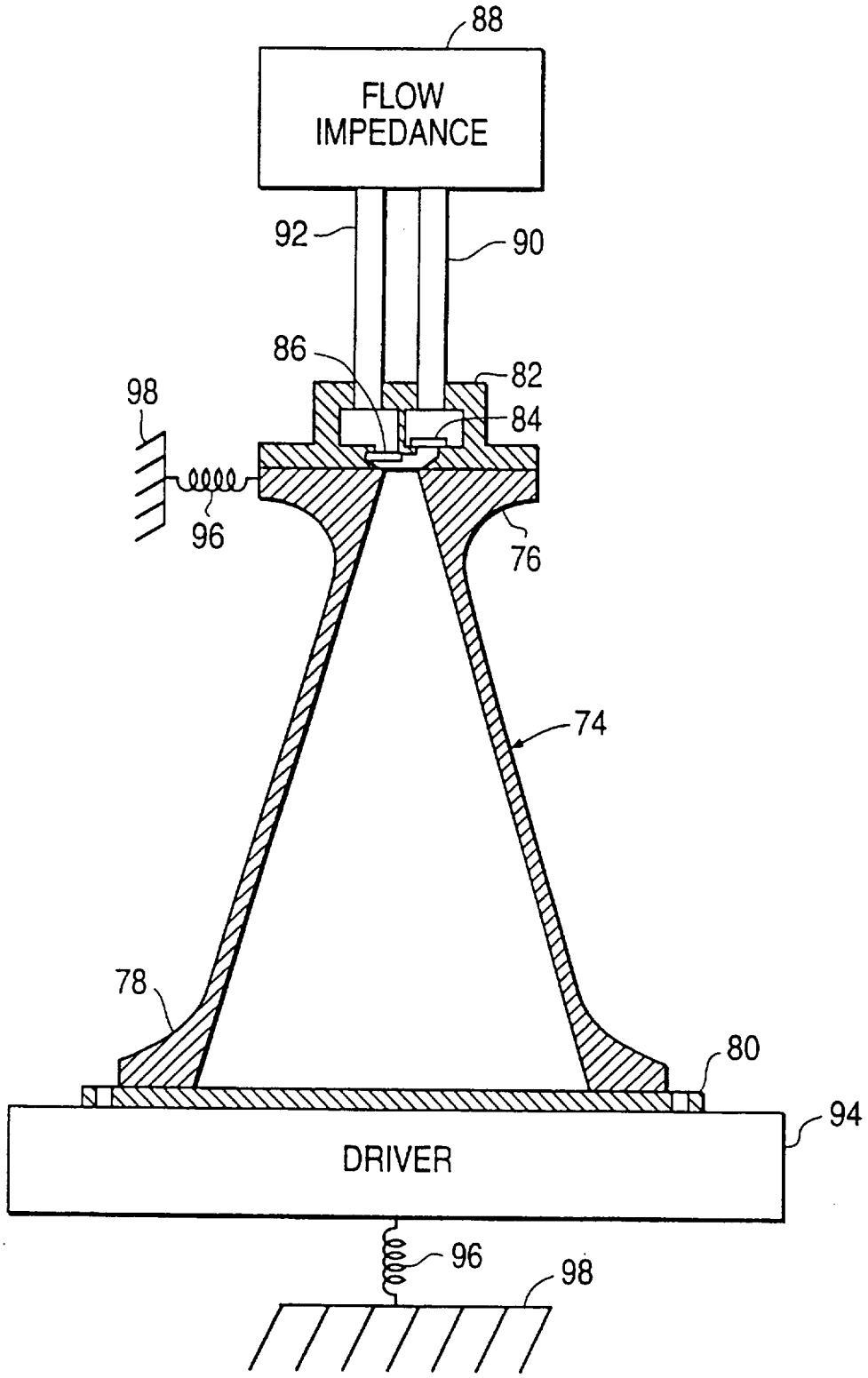
FIGS. 15A and 15B are sectional views of a resonator in accordance with the present invention which is employed in an acoustic compressor.
Figure 15B:
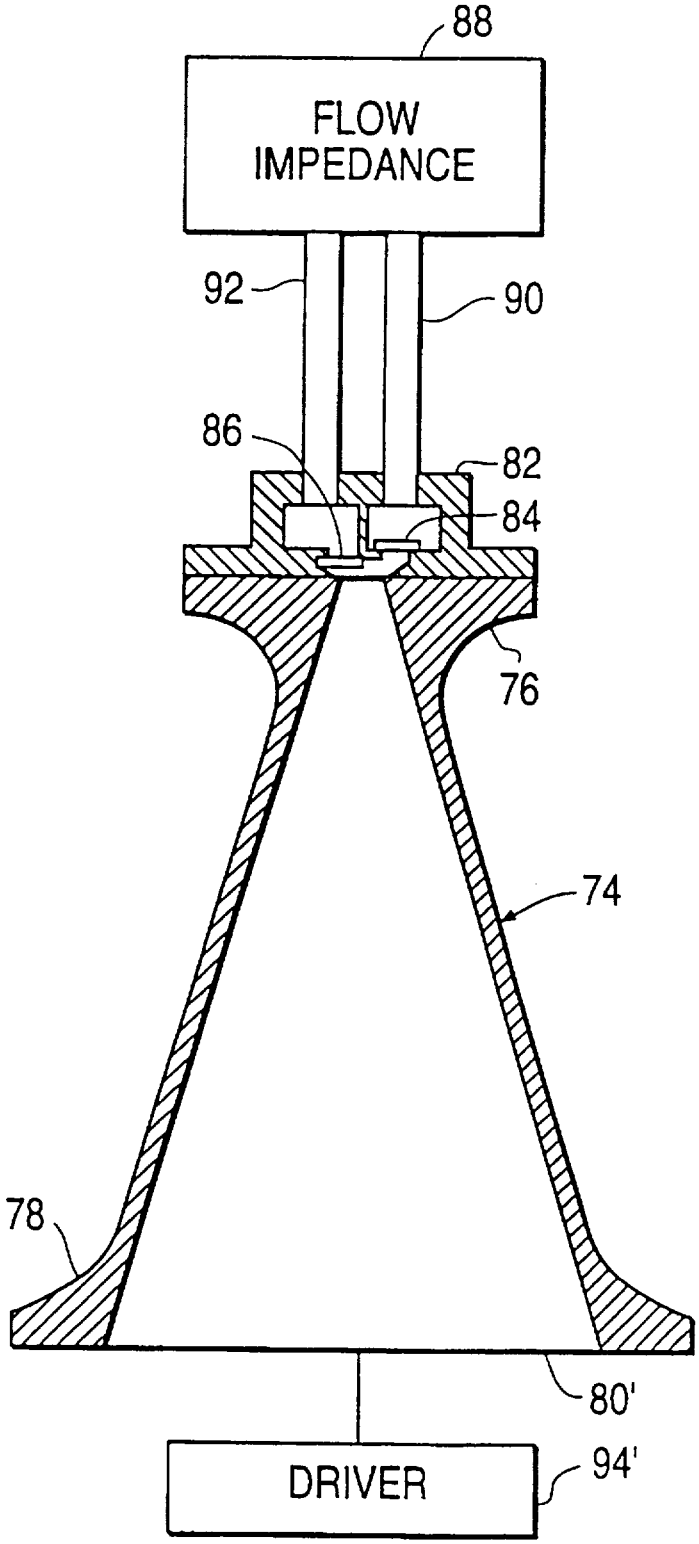
Figure 16:
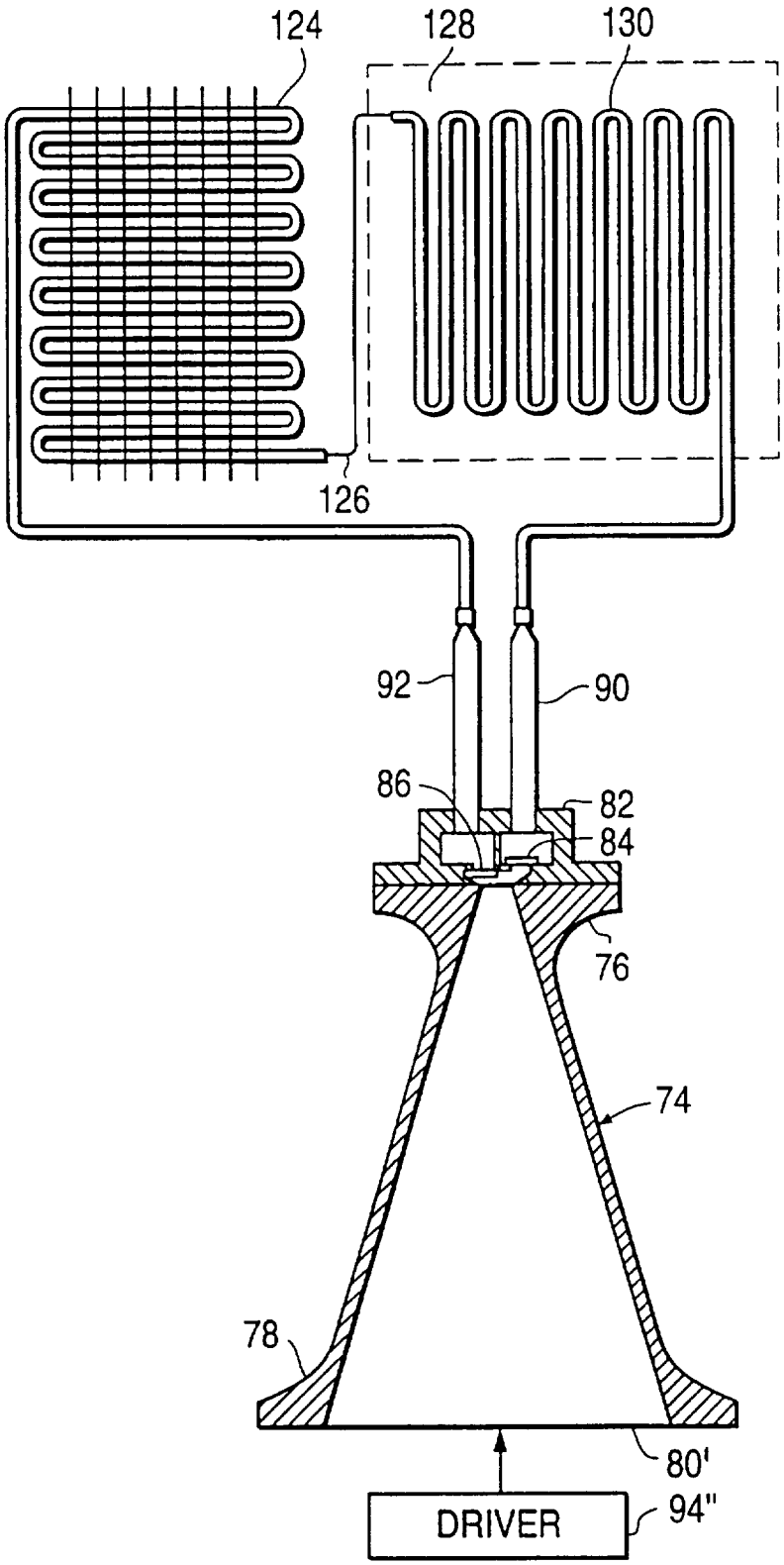
FIG. 16 is a sectional view of a resonator in accordance with the invention shown within a compressor/evaporation system.

Specific mechanical means for providing the driving power to the following embodiments of the present invention are described in U.S. Pat. Nos. 5,319,938 and 5,231,337 the entire contents of which are hereby incorporated by reference. The driving method used in FIGS. 5, 6, 7, 9, 11 and 13 assumes a resonator having reflective terminations at each end, which is oscillated (driven) along its cylindrical axis at the frequency of a mode. Alternatively, a resonator can be driven by replacing one of the reflective terminations with a vibrating piston. Drive power can also be thermally delivered, as in the case of a thermoacoustic prime mover (as in U.S. Pat. Nos. 4,953,366 and 4,858,441) or by exploiting a fluid's periodic absorption of electromagnetic energy as in U.S. Pat. No. 5,020,977. Detail driving methods are omitted in the following discussions and drawings for simplicity, although FIGS. 15A, 15B and 16 show block diagrams of a driver connected to drive a resonator which is also connected to a flow impedance.

For an anharmonic resonator it is difficult to predict a harmonic's phase merely by its proximity to a given resonant mode. However, the harmonic phases and other properties of the resonator can be predicted with existing analytical methods. Such properties can include the particle velocity, resonant mode frequencies, power consumption, resonance quality factor, harmonic phases and amplitudes and resulting waveforms. Determination of the acoustic field inside a resonator depends on the solution of a differential equation that describes the behavior of a fluid when high amplitude sound waves are present. One nonlinear equation that may be used is the NTT wave equation (J. Naze Tjøtta and S. Tjøtta, "Interaction of sound waves. Part I: Basic equations and plane waves," *J. Acoust. Soc. Am.* 82, 1425–1428 (1987)), which is given by $$\left(\nabla^2 - \frac{1}{c_0^2}\frac{\partial^2}{\partial t^2}\right)p + \frac{\delta}{c_0^4}\frac{\partial^3 p}{\partial t^3} = -\frac{\beta}{\rho_0 c_0^4}\frac{\partial^2 p^2}{\partial t^2} - \left(\nabla^2 + \frac{1}{c_0^2}\frac{\partial^2}{\partial t^2}\right)L \qquad \text{Equation 2}$$

where the coefficient of nonlinearity is defined by $\beta = 1 + B/2A$. The Lagrangian density L is defined by:

$$L = \frac{\rho_0 u^2}{2} - \frac{p^2}{2\rho_0 c_0^2} \qquad \text{Equation 3}$$

The variable p is the acoustic pressure; u is the acoustic particle velocity; t is time; x, y, and z are space variables; $c_0$ is the small signal sound speed; $\rho_0$ is the ambient density of the fluid; B/2A is the parameter of nonlinearity (R. T. Beyer, "Parameter of nonlinearity in fluids," *J. Acoust Soc. Am.* 32, 719–721 (1960)); and $\delta$ is referred to as the sound diffusivity, which accounts for the effects of viscosity and heat conduction on a wave propagating in free space (M. J. Lighthill, *Surveys in Mechanics*, edited by G. K. Batchelor and R. M. Davies (Cambridge University Press, Cambridge, England, 1956), pp. 250–351).

For the embodiments of the present invention described in FIGS. 8, 10, 12 and 14 the theoretical values are predicted by solutions of Equation 2. The solutions are based on a lossless ($\delta = 0$) version of Equation 2 restricted to one spatial dimension (z). Losses are included on an ad hoc basis by calculating thermoviscous boundary layer losses (G. W. Swift, "Thermoacoustic engines," *J. Acoust. Soc. Am.* 84, 1145–1180 (1988)).

The method used to solve Equation 2 is a finite element analysis. For each finite element the method of successive approximations (to third order) is applied to the nonlinear wave equation described by Equation 2 to derive linear differential equations which describe the acoustic fields at the fundamental, second harmonic and third harmonic frequencies. The coefficient of nonlinearity $\beta$ is determined by experiment for any given fluid. The analysis is carried out on a computer having a central processing unit and program and data memory (ROM and RAM respectively). The computer is programmed to solve Equation 2 using the finite element analysis described above. The computer is provided with a display in the form of a monitor and/or printer to permit output of the calculations and display of the waveform shapes for each harmonic.

The comparisons of theory and experiment shown for the embodiments of the present invention in FIGS. 8, 10, 12 and 14 reveal good agreement between predicted and measured data. More accurate mathematical models may be developed by solving Equation 2 for 2 or 3 spatial dimensions. Also, a more exact wave equation can be used (Equation 2 is exact to quadratic order in the acoustic pressure).

For the embodiments of the present invention described in the remainder of this section the solutions of Equation 2 are used to provide predictions of harmonic phase and amplitude. The simple concepts developed for illustration in the previous section for harmonic resonators (i.e., the relative position of modes and harmonics in the frequency domain) are considered as well and are shown not to be uniformly valid.

First, a simple embodiment of the present invention which will provide AP waves is considered. Referring to FIGS. 2 and 3, the phases which provided AP wave $f_3$ were obtained by placing the frequencies of the lower harmonics (nf) between the frequencies of modes n and n+1. Similar mode-harmonic proximities can exist in anharmonic resonators which provide AP waves.

Figure 7:
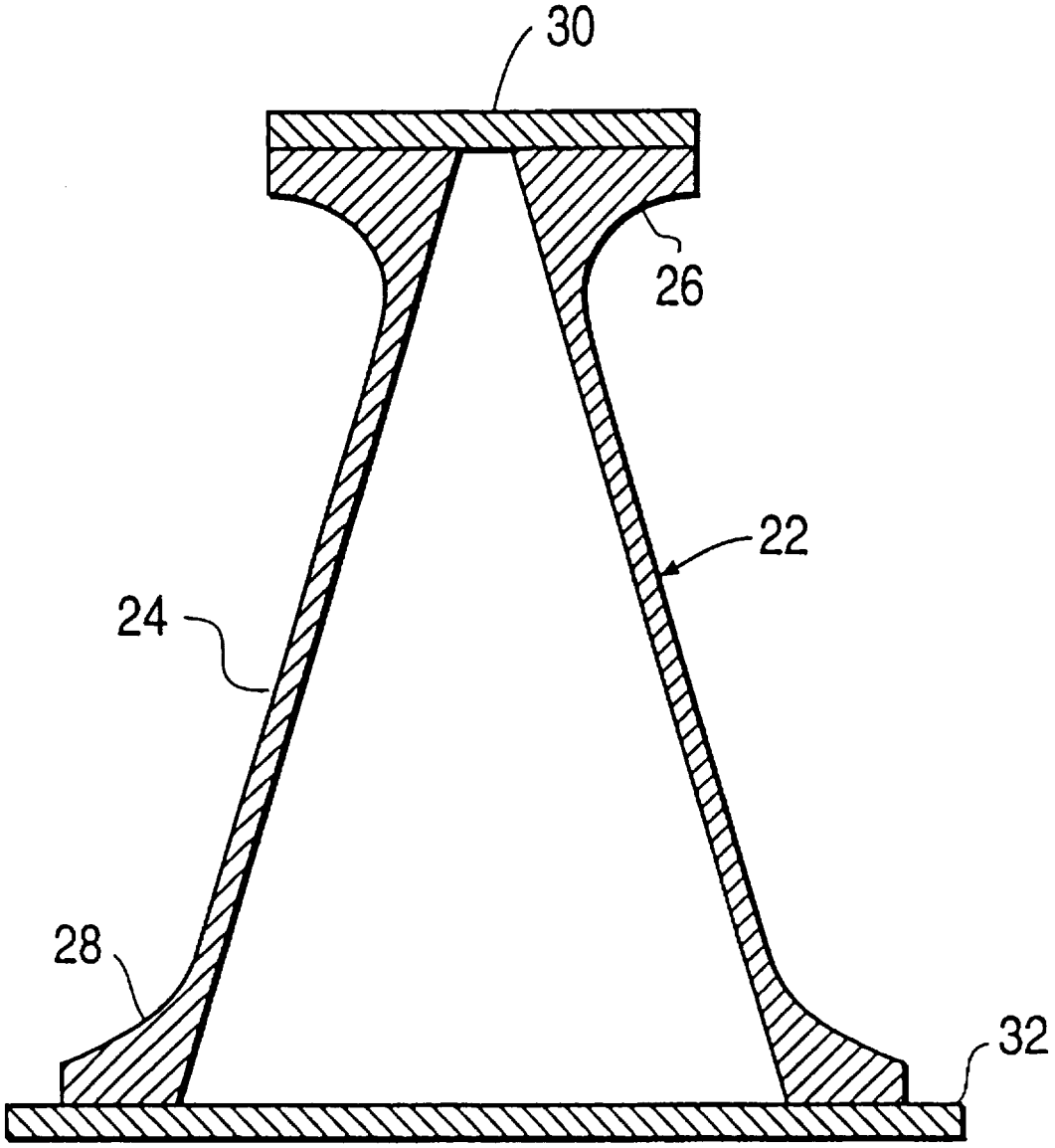
FIG. 7 is a sectional view of a resonator in accordance with the present invention which employs a distributed impedance change geometry for producing asymmetric positive waveforms.

Anharmonic DI resonator 22 of FIG. 7 provides an on-resonance AP wave. Resonator 22 is formed by a conical chamber 24 which has a throat flange 26 and a mouth flange 28. The two open ends of conical chamber 24 are rigidly terminated by a throat plate 30 and a mouth plate 32, fastened respectively to throat flange 26 and mouth flange 28. The axial length of chamber 24 alone is 17.14 cm and the respective chamber inner diameters at the throat (smaller end) and mouth (larger end) are 0.97 cm and 10.15 cm.

Figure 8:
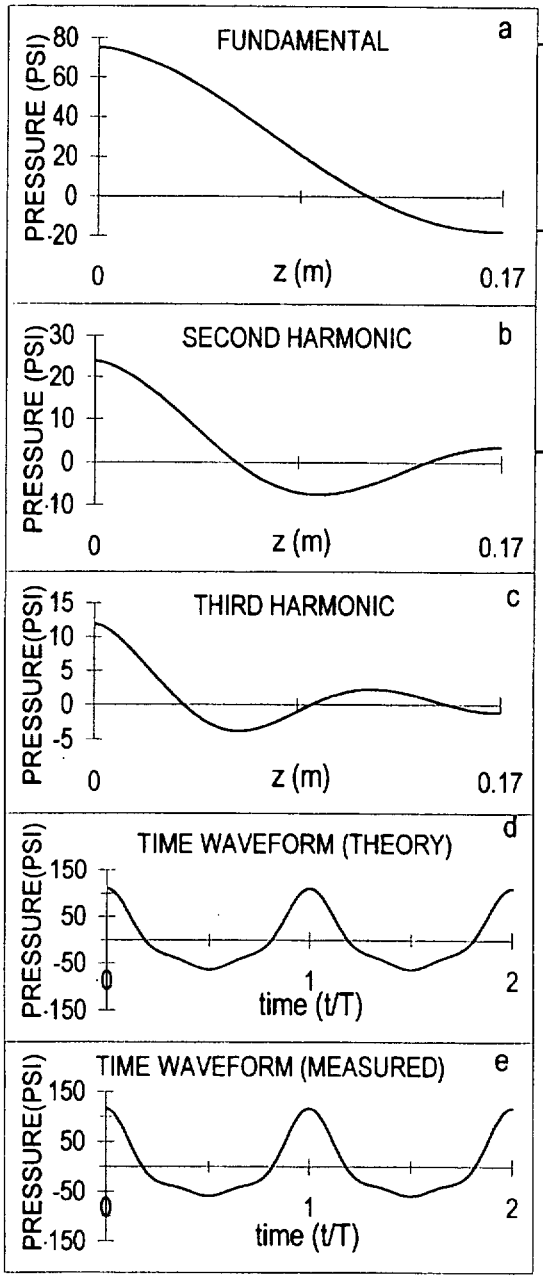
FIG. 8 provides theoretical and experimental data for the resonator shown in FIG. 7.

FIG. 8 shows the calculated design phases and pressure distributions along the axial length L of resonator 22 for the fundamental and 2nd and 3rd harmonics, e.g., graphs (a), (b) and (c) respectively. Also shown is the net pressure waveform, graph (d), obtained by the summation in time (using Equation 1) ) of the fundamental, 2nd and 3nd harmonics with the proper phases $\phi_n$ and amplitudes $A_n$ at the throat end (z=0) of resonator 22 using Equation 2. For comparison is the waveform, graph (e), constructed from the amplitudes and phases of the fundamental and 2nd and 3rd harmonics measured when the resonator was charged with HFC-134a to a pressure of 85 psia. As in the case of an AP wave in a harmonic resonator the frequencies of the lower harmonics (nf) are between the frequencies of modes n and n+1.

When a ¾ scaled-up version of resonator 22 was pressurized to 85 psia with HFC-134a, waveforms were generated with acoustic particle velocities above MACH 1 and associated peak-to-peak pressure oscillations above 400 psi.

DI resonators, like resonator 22 of FIG. 7, can provide AP waves which are useful in Rankine-cycle applications, as discussed above. Other applications may require different wave properties. For example, a given application may require keeping $|P_+|$ constant and increasing $|P_-|$ by 25% while reducing power consumption.

Figure 9:
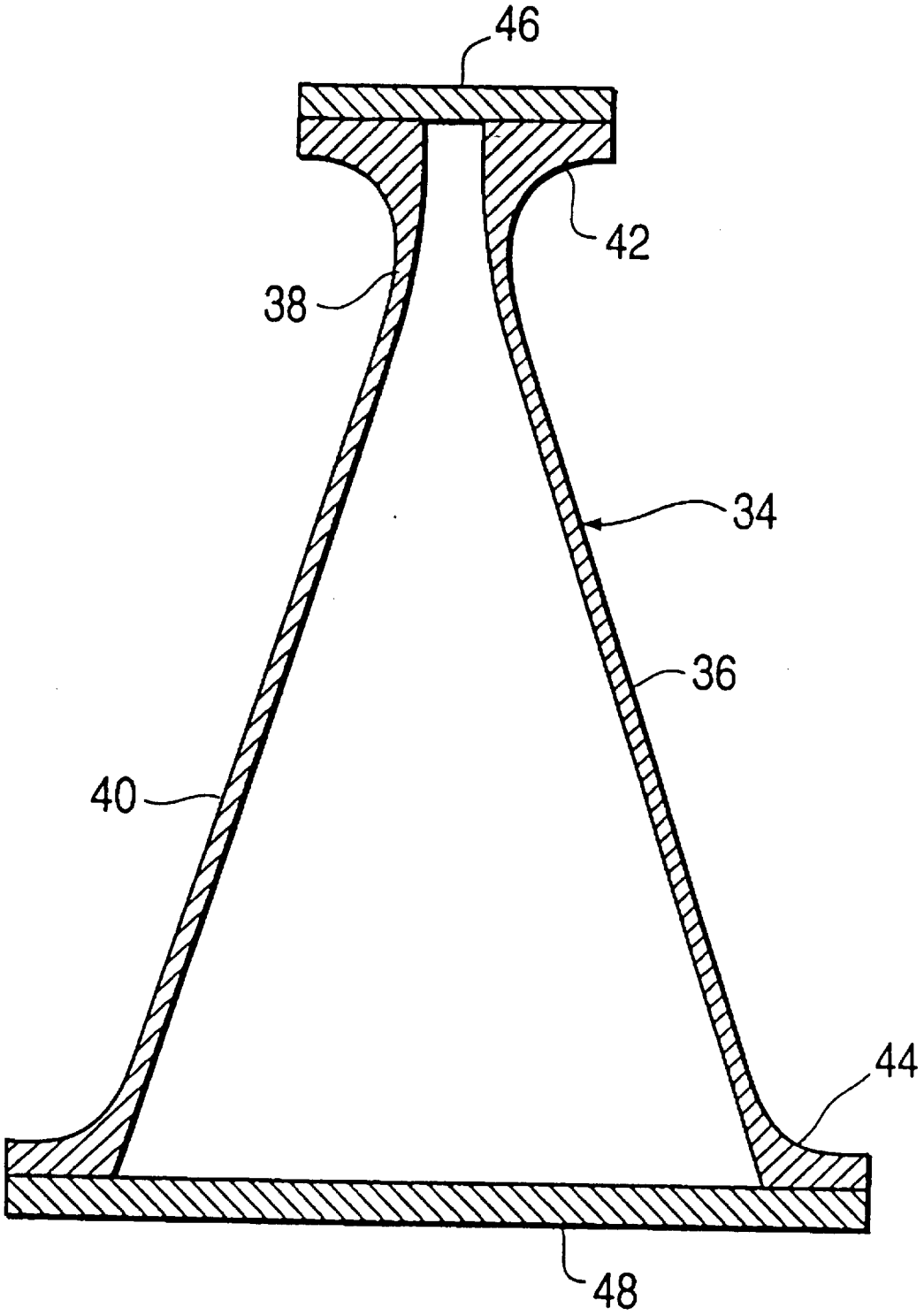
FIG. 9 is a sectional view of a resonator in accordance with the present invention which employs a distributed impedance change geometry for altering the harmonic amplitudes of the resonator in FIG. 7.
Figure 10:
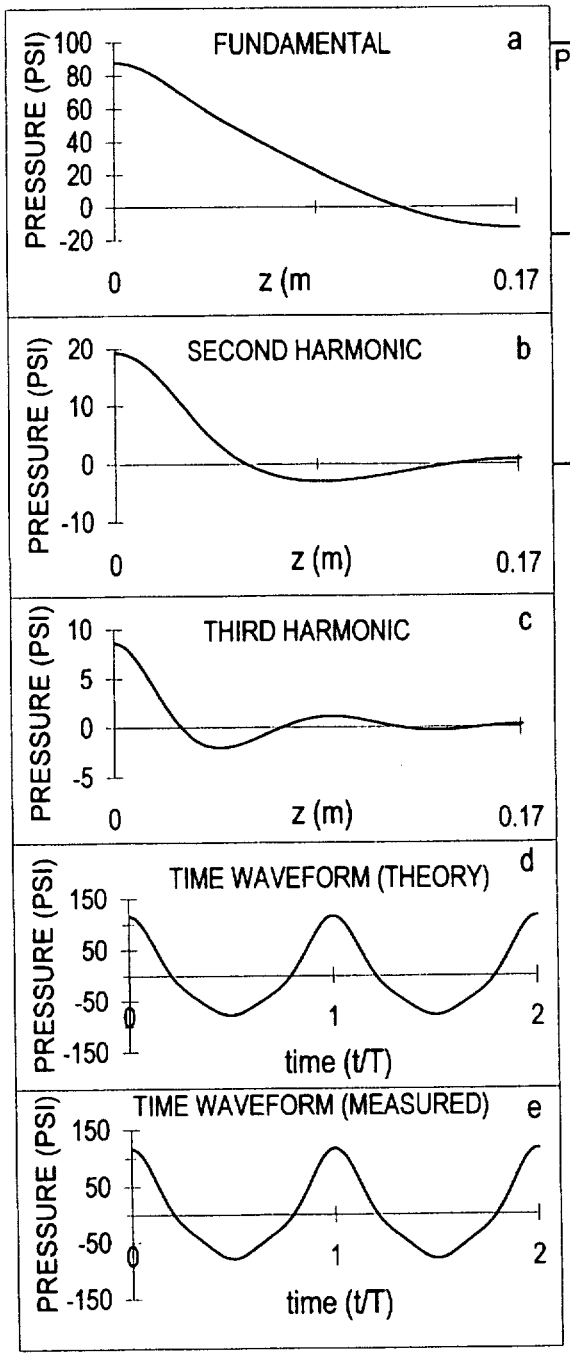
FIG. 10 provides theoretical and experimental data for the resonator shown in FIG. 9.

Anharmonic resonator 34 of FIGS. 9 and 10 provides one of the many possible approaches to meet the design requirements of increased $|P_-|$ and reduced power consumption. Using resonator 22 as a starting point, we can see from the (+90° ) curves in FIG. 4 that reducing the 2nd harmonic amplitude will increase $|P_-|$ if phase remains unchanged. Alternatively, increasing the 3nd harmonic amplitude will increase $|P_-|$. As shown in FIG. 8, conical resonator 22 allows very high relative amplitude harmonics to exist. In order to alter the harmonic amplitudes, a change in the boundary conditions of conical resonator 22 is required, such as making $d^2r/dz^2$ non-zero at some point. Resonator 34 of FIG. 9 provides an appropriate boundary condition change and is formed by a chamber 36 having a curved section 38, a conical section 40, a throat flange 42 and a mouth flange 44. Resonator 34 is rigidly terminated by a throat plate 46 and a mouth plate 48. The axial length of chamber 36 alone is 17.14 cm and the mouth inner diameter is 10.15 cm. Curved section 38 is 4.28 cm long, and its diameter as a function of axial coordinate z is given by:

$$D(z) = \frac{D_{th}}{2}\{e^{mz} + e^{-mz}\}$$

where z is in meters, m=33.4 and $D_{th}$=0.097 m.

FIG. 10 shows the calculated design data for resonator 34, (graphs (a)–(d)) including the waveform constructed from measured data (graph (e)) for a 85 psia charge of HFC-134a. The relative amplitude of the 2nd harmonic has been reduced from 0.388 for resonator 22 (29.2 psi for the second harmonic divided by 75.3 psi for the fundamental), to 0.214 psi for resonator 34 (18.88 psi divided by 88.02 psi). This reduction in 2nd harmonic leads to a 25% increase in $|P_-|$. Power consumption has also been reduced.

Another simple embodiment of the present invention is anharmonic DI resonator 50, which is designed to provide AN waves. Resonator 50 is formed by a curved chamber 52, having a throat flange 54 and a mouth flange 56. The two open ends of curved chamber 52 are rigidly terminated by a throat plate 58 and a mouth plate 60, fastened respectively to throat flange 54 and mouth flange 56. The axial length of chamber 52 alone is 24.24 cm and the mouth inner diameter is 9.12 cm. The inner diameter of chamber 52, as a function of axial coordinate z, is given by:

$$D(z)=0.0137+0.03z+20_z^4$$

where z is in meters, and z=0 is at the throat (amaller) end of the chamber. FIG. 12 shows the calculated design data for resonator 50. The calculated time waveform shows the desired AN symmetry, which results from the −90° phase of the 2nd harmonic. Referring to FIGS. 2, 3 and 4A–4C, the phases which produced AN wave $f_1$ for a harmonic resonator were obtained by placing frequencies nf of the harmonics between the frequencies of modes n−1 and n. Anharmonic DI resonator 50 of FIGS. 11 and 12, which produces AN waves, also has harmonic frequencies nf between the frequencies of modes n−1 and n for n=2 and 3.

Figure 11:
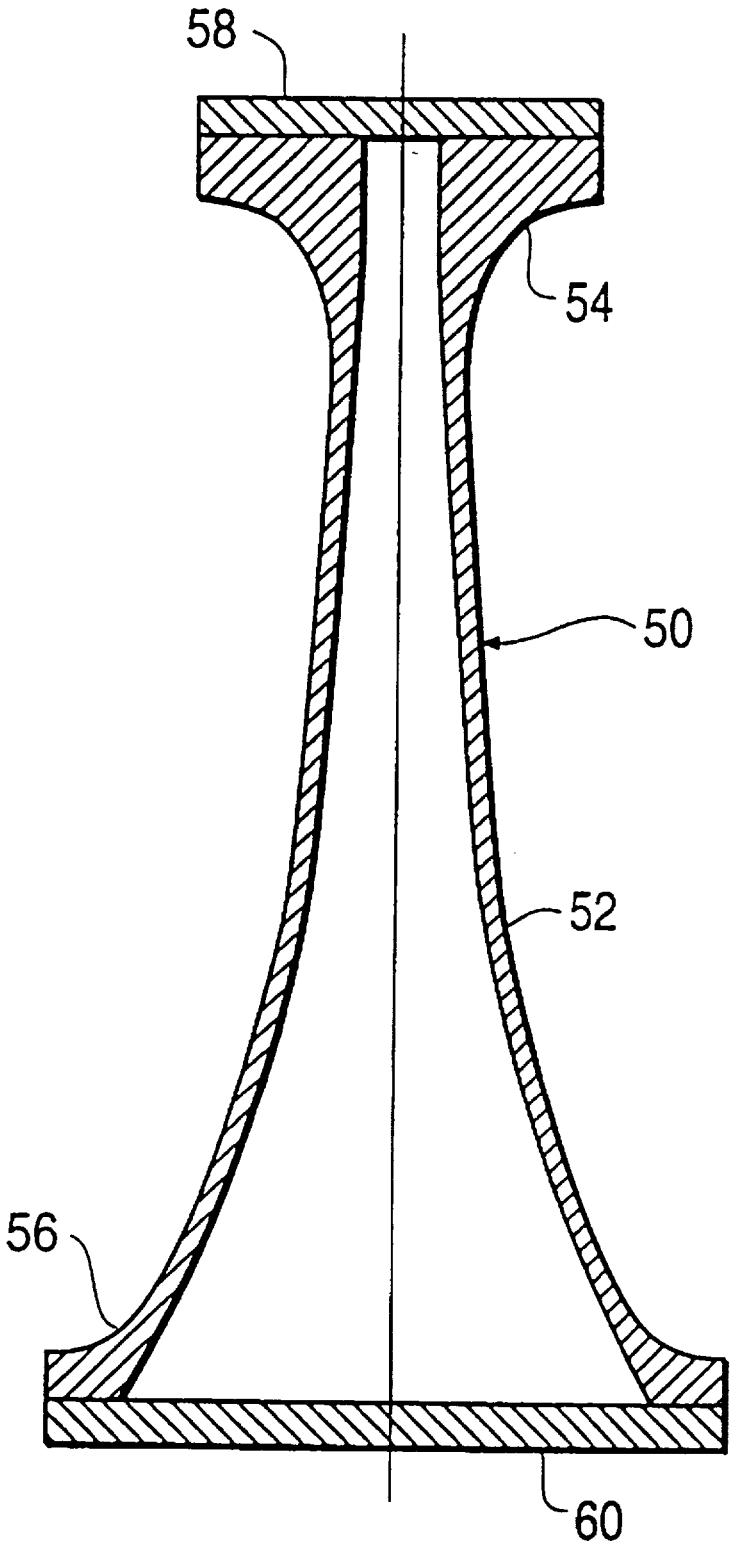
FIG. 11 is a sectional view of a resonator in accordance with the present invention which employs a distributed impedance change geometry for producing asymmetric negative waveforms.
Figure 12:
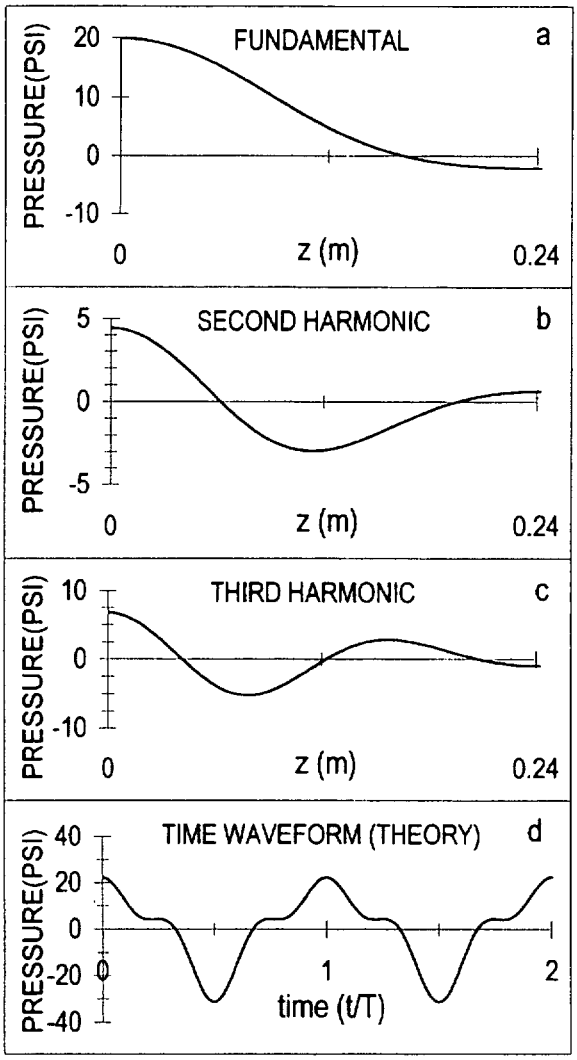
FIG. 12 provides theoretical data for the resonator shown in FIG. 11.

In the anharmonic resonators 22 and 50 of FIGS. 7 and 11 respectively, AP and AN waves were provided. In both cases, the simple concepts illustrated for harmonic resonators which relate harmonic phase to the relative position in the frequency domain of harmonics and modes were also valid for the anharmonic resonators. While these simple cases help to provide some insight, the simple concepts illustrated for harmonic resonators are not always valid for anharmonic resonators and are not sufficiently sophisticated to realize the present invention's potential. Rigorous mathematical models such as the one based on Equation 2 are best suited to the design of the present invention.

Figure 13:
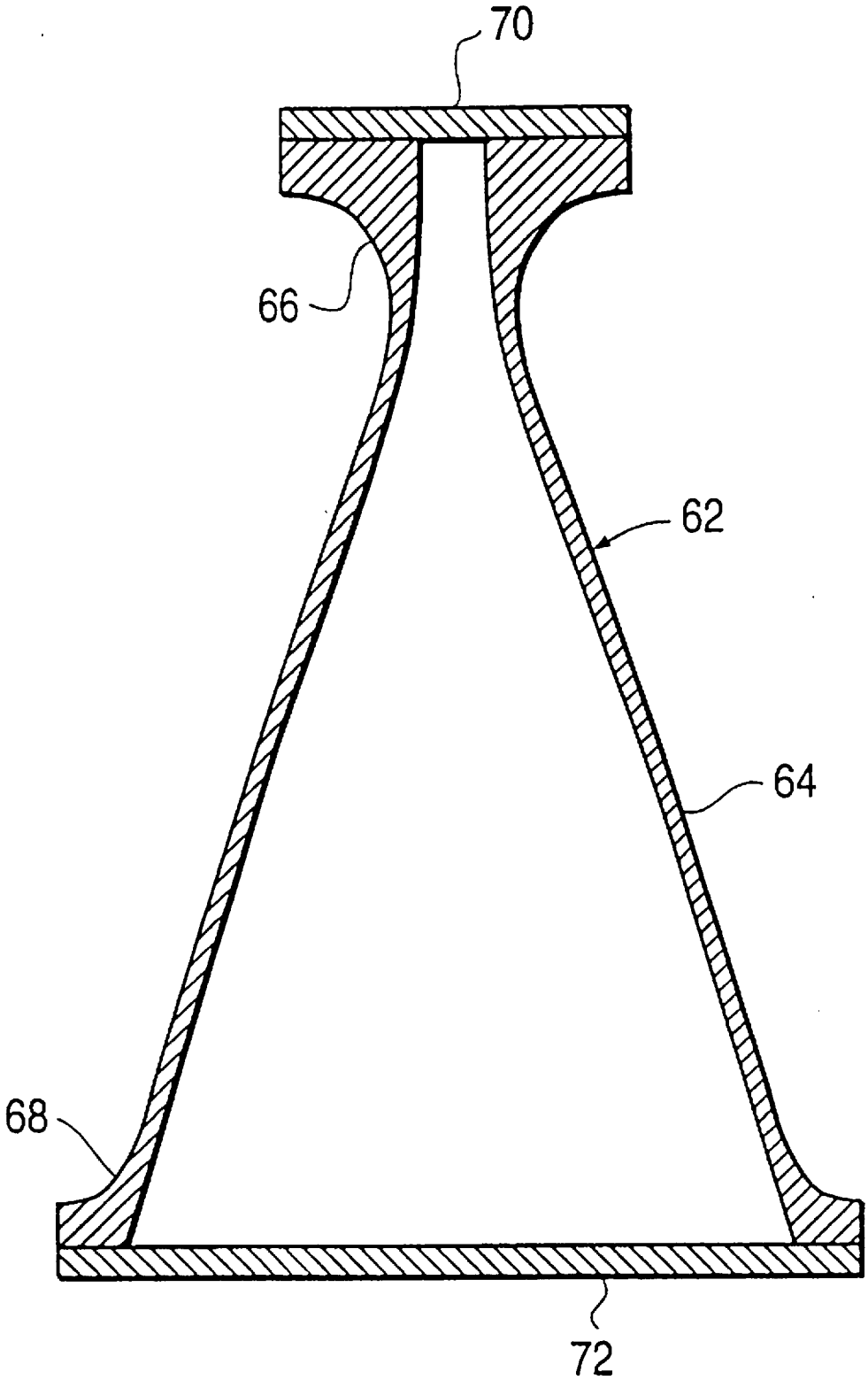
FIG. 13 is a sectional view of a resonator in accordance with the present invention which employs a distributed impedance change geometry for producing asymmetric negative waveforms.
Figure 14:
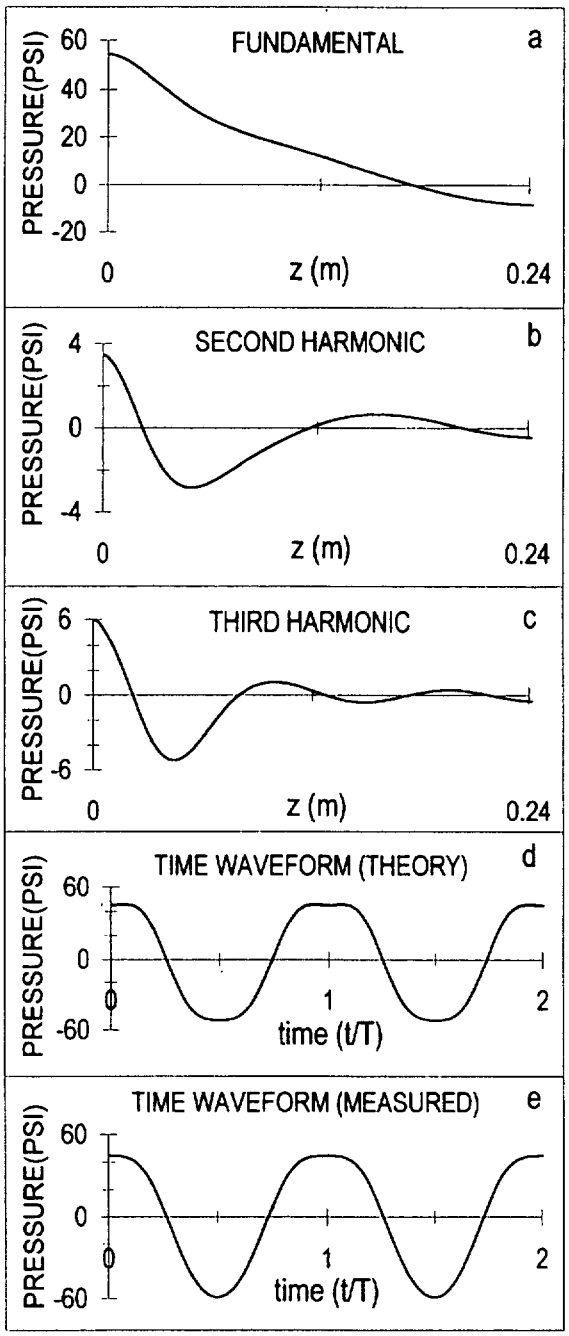
FIG. 14 provides theoretical and experimental data for the resonator shown in FIG. 13.

For example, a resonator's modes need not be shifted up in frequency, as in resonator 50, in order to provide AN waves. FIGS. 13 and 14 show a resonator 62 whose modes are shifted down in frequency, similar to resonator 22. Unlike resonator 22, which produces AP waves, resonator 62 provides AN waves.

Resonator 62 is formed by a curved chamber 64, having a throat flange 66 and a mouth flange 68. The two open ends of curved chamber 64 are rigidly terminated by a throat plate 70 and a mouth plate 72, fastened respectively to throat flange 66 and mouth flange 68. The axial length of chamber 64 alone is 24.24 cm. The inner diameter of chamber 64, as a function of axial coordinate z, is given by:

$$D(z) = 1.244 \times 10^{-2} - 1.064z + 95.74z^2 - 3.71 \times 10^3 z^3 +$$

$$1.838 \times 10^4 z^4 - 9.285 \times 10^5 z^5 + 6.56 \times 10^6 z^6 - 2.82 \times 10^7 z^7 +$$

-continued $$7.2 \times 10^7 z^8 - 9.87 \times 10^7 z^9 + 5.459 \times 10^7 z^{10}$$

where z is in meters and the coordinate origin is at the throat open end of the resonator 62.

FIG. 14 shows the calculated design data for resonator 62, including the waveform constructed from data measured when resonator 62 was charged with HFC-134a to a pressure of 85 psia. The desired AN wave symmetry, which results from the −90° 2nd harmonic phase is present for the theoretical and measured waveforms.

The resonators of the present invention are ideal for use in acoustic compressors. Acoustic compressors and their various valve arrangements are discussed in U.S. Pat. Nos. 5,020,977, 5,167,124 and 5,319,938, the entire contents of which are hereby incorporated by reference. In general, acoustic compressors can be used for many applications. Some examples include the compression or pumping of fluids or high purity fluids, heat transfer cycles, gas transport and processing and energy conversion.

FIGS. 15A and 15B illustrate an acoustic compressor in a closed cycle, which uses a resonator of the present invention. In FIG. 15A, resonator 74 has a throat flange 76 and a mouth flange 78. Resonator 74 is rigidly terminated by a mouth plate 80 fastened to mouth flange 78. A valve head 82 is attached to throat flange 76 and has a discharge valve 84 and a suction valve 86, which are respectively connected to flow impedance 88 by conduits 90 and 92. Discharge valve 84 and suction valve 86 serve to convert the oscillating pressure within resonator 74 into a net fluid flow through flow impedance 88. Flow impedance 88 could include a heat exchange system or an energy conversion device. The resonator 74 may be preferably driven by a driver 94, such as an electromagnetic shaker well known in the art, which mechanically oscillates the entire resonator 74 in a manner described in either of U.S. Pat. Nos. 5,319,938 and 5,231,337 incorporated herein by reference. Resilient mountings 96 are provided to secure the resonator 74 and driver 94 to a fixed member 98 which secures the resonator/driver assembly.

FIG. 15B is similar to FIG. 15A wherein the mouth plate 80 of the resonator 74 is replaced by a piston 80' in which case driver 94' takes the form of an electromagnetic driver such as a voice coil driver for oscillating the piston. This arrangement is well known to those of skill in the art.

FIG. 16 illustrates the use of the resonator 74 as a compressor, in a compression-evaporation refrigeration system. In FIG. 16, the resonator is connected in a closed loop, consisting of a condenser 124, capillary tube 126, and evaporator 130. This arrangement constitutes a typical compression-evaporation system, which can be used for refrigeration, air-conditioning, heat pumps or other heat transfer applications. In this case, the fluid comprises a compression-evaporation refrigerant. The driver 94" may be either an entire resonator driver per FIG. 15A or a piston type driver per FIG. 15B.

In operation, a pressurized liquid refrigerant flows into evaporator 130 from capillary tube 126 (serving as a pressure reduction device), therein experiencing a drop in pressure. This low pressure liquid refrigerant inside evaporator 130 then absorbs its heat of vaporization from the refrigerated space 128, thereby becoming a low pressure vapor. The standing wave compressor maintains a low suction pressure, whereby the low pressure vaporous refrigerant is drawn out of evaporator 130 and into the standing wave resonator 74. This low pressure vaporous refrigerant is then acoustically compressed within resonator 74, and subsequently discharged into condenser 124 at a higher pressure and temperature. As the high pressure gaseous refrigerant passes through condenser 124, it gives up heat and condenses into a pressurized liquid once again,. This pressurize liquid refrigerant then flows through capillary tube 126, and the thermodynamic cycle repeats.

The advantages of resonators having changing cross-sectional area, such as reduced particle velocity, viscous energy dissipation and thermal energy dissipation, are explained in U.S. Pat. No. 5,319,938, which is hereby incorporated by reference for these features.

It is noted that in the preferred embodiments of the resonator chamber illustrated in FIGS. 7, 9, 11, 13 and 15, the chamber has an interior region which is structurally empty and contains only the fluid (e.g., refrigerant). Production of the desired waveform is achieved by changing the internal cross sectional area of the chamber along the longitudinal, z, axis so as to achieve the desired harmonic phases and amplitudes without producing undue turbulence.

While the above description contains many dimensional specifications, these should not be construed as limitations on the scope of the invention, but rather as exemplifications of preferred embodiments thereof. The preferred embodiments focus on the resonant synthesis of a desired waveform within resonators of very simple geometry. Thus, the scope of the present invention is not limited to a specific resonator design, but rather to the exploitation of a resonator's boundary conditions to control harmonic amplitude and phase, thereby providing Resonant Macrosonic Synthesis.

The number of specific embodiments of the present invention is as varied as the number of desired properties. Such properties could include energy consumption, the ratio of throat-to-mouth pressure amplitudes, resonance quality factor, desired pressure amplitudes, exact waveform and the operating fluid. There is a continuum of resonator geometries having the boundary conditions needed to provide a given property. A resonator's boundary conditions can be altered by changing the wall geometry, which includes flat or curved mouth plates and throat plates. Variation of plate curvature can be used to alter mode frequencies, acoustic particle velocity, resonance quality factor and energy consumption. The exact geometry chosen for a given design will reflect the order of importance of the desired properties. In general, a resonator's geometry could be cylindrical, spherical, toroidal, conical, horn-shaped or combinations of the above.

An important characteristic of the invention is the ability to achieve steady state waveforms which are synthesized as a result of selection of the chamber boundary conditions, i.e., the waveforms persist over time as the compressor is being operated. Thus, in one preferred application to relatively low pressure compressors, the steady state operation of the compressor would supply steady state peak to peak pressure amplitudes as a percentage of mean pressure in the ranges of 0.5–25%, or more selectively between one of: 0.5–1.0%; 1.0–5.0%; 5.0–10.%; 10–15%; 15–20%; 20–25%; 10–25%; 15–25% and 20–25%. In relatively moderate pressure applications, the percentages may range from 25–100% and more selectively between one of: 30–100%; 40–100%; 50–100%; 60–100%; 70–100%; 80–100% and 90–100%. In relatively high pressure applications these percentages may include values greater than 100% and more selectively values greater than any one of: 125%; 150%; 175%; 200%; 300% and 500%.

There are many ways to exploit the basic features of the present invention which will readily occur to one skilled in the art. For example, the waveforms provided by the present invention are not limited to those discussed herein. The present invention can provide different phases and relative amplitudes for each harmonic by varying the boundary conditions of the resonator, thereby providing a wide variety of means to control the resulting waveform. Also, the phase effects imparted to a harmonic by a resonant mode are not restricted to only longitudinal modes.

Furthermore, non-sinusoidal waves do not have to be pressure asymmetric. Shock-free waves can be non-sinusoidal and pressure symmetric by providing low even-harmonic amplitudes and high odd-harmonic amplitudes with non-zero phases. Thus, the present invention can provide a continuum of pressure asymmetry.

Still further, the resonators of the present invention can be scaled up or down in size and still provide similar waveforms, even though operating frequencies and power consumption can change. Accordingly, the scope of the invention should be determined not by the embodiments illustrated, but by the appended claims and their equivalents.

What is claimed is:

1. An anharmonic acoustic resonator comprising a chamber being mechanically driven and containing a fluid, said chamber being driven at a resonant mode and having means, including at least an internal wall configuration of said chamber, which provide the harmonic phases and amplitudes such as to synthesize a, non-sinusoidal, unshocked waveform.

2. An acoustic resonator as set forth in claim 1, wherein said internal wall configuration is such as to produce said non-sinusoidal unshocked wave having an asymmetric positive pressure symmetry at a point within said chamber.

3. An acoustic resonator as set forth in claim 1, wherein said internal wall configuration is such as to produce said non-sinusoidal unshocked wave having an asymmetric negative pressure symmetry at a point within said chamber.

4. An acoustic resonator as set forth in claim 1, wherein said internal wall configuration is such as to produce said non-sinusoidal unshocked wave having a symmetric pressure symmetry at a point within said chamber.

5. An acoustic resonator as set forth in claim 1, wherein said chamber having ends and reflective terminations at each end of said chamber, further comprising means for mechanically oscillating said chamber at a frequency of said resonant mode.

6. An acoustic resonator as set forth in claim 1, wherein said chamber having an open end and a closed end with a reflective termination, further comprising a moving piston coupled to the open end of said chamber, said moving piston oscillating at a frequency of said resonant mode.

7. An acoustic resonator as set forth in claim 1, wherein said chamber comprises a resonant chamber for an acoustic compressor.

8. An acoustic resonator as set forth in claim 1, wherein the fluid is a liquid.

9. An acoustic resonator as set forth in claim 1, wherein the fluid is a gas.

10. An acoustic resonator as set forth in claim 1, wherein said chamber substantially comprises a conical geometry.

11. An acoustic resonator as set forth in claim 1, wherein said chamber substantially comprises a curved geometry.

12. An acoustic resonator as set forth in claim 1, wherein said chamber includes a curved section and a conical section.

13. An anharmonic acoustic resonator comprising a chamber being mechanically driven and containing a fluid, said chamber being driven at a resonant mode and having means, including at least an internal wall configuration of said chamber, which provide the harmonic phases and amplitudes such as to synthesize a non-sinusoidal, unshocked waveform, said chamber having ends and rigid reflective terminations at each end of said chamber, and further comprising a driver for mechanically oscillating the entire chamber at a frequency of said resonant mode.

14. An anharmonic acoustic resonator for use in a compression-evaporation system comprising a chamber having rigid interior walls surrounding a longitudinal axis of said chamber and two rigid end walls having acoustic reflective terminations, said interior walls and end walls defining a space within said chamber for containing a refrigerant, said chamber interior walls, end walls and refrigerant defining boundary conditions which provide the harmonic phases and amplitudes such as to synthesize a non-sinusoidal, unshocked waveform, said resonator having a driver for mechanically oscillating the entire chamber at a frequency of a resonant mode of said chamber.

15. An anharmonic acoustic resonator for use in a compression-evaporation system comprising a chamber having rigid interior walls surrounding a longitudinal axis of said chamber and two rigid end walls having acoustic reflective terminations, said interior walls and end walls defining a space within said chamber for containing a refrigerant, said chamber interior walls, end walls and refrigerant defining boundary conditions which provide the harmonic phases and amplitudes such as to synthesize a non-sinusoidal, unshocked waveform and having a distributed impedance such as to minimize turbulence, said resonator having a driver for mechanically oscillating the entire chamber at a frequency of a resonant mode of said chamber.

16. An acoustic resonator comprising a chamber containing a fluid, said chamber having anharmonic modes and having an inner radius r and an axial coordinate z, where dr/dz is continuous wherever particle velocities are high so as to minimize turbulence.

17. An acoustic resonator as set forth in claim 16, wherein $d^2r/d^2z$ does not exceed a value which would cause substantial turbulence for a predetermined acoustic particle velocity.

18. An anharmonic acoustic resonator comprising a chamber being heat driven and containing a fluid, said chamber being driven at a resonant mode and having means, including at least an internal wall configuration of said chamber, which provides the harmonic phase and amplitudes such as to synthesize a non-sinusoidal, unshocked waveform.

19. An acoustic resonator as set forth in claim 18, wherein said chamber includes a thermoacoustic driving means.

20. An acoustic resonator as set forth in claim 18, wherein said chamber is driven by periodic absorption of electromagnetic energy.

21. A method for producing acoustic resonance in a chamber, comprising the steps of:

introducing a fluid into the chamber; and mechanically oscillating the chamber at a frequency of a selected resonant mode; and producing the harmonic phases and amplitudes such as to synthesize a non-sinusoidal unshocked waveform.

22. A method for producing acoustic resonance in a chamber, comprising the steps of:

introducing a fluid into the chamber; and thermally driving the chamber at a frequency of a selected resonant mode; and producing the harmonic phases and amplitudes such as to synthesize a non-sinusoidal, unshocked waveform.

23. An acoustic compression system comprising:

a chamber containing a fluid, said chamber having means, including at least an internal wall configuration of said chamber, which provide the harmonic phases and amplitudes such as to synthesize a non-sinusoidal unshocked waveform in said fluid;

a driver coupled to said chamber, for causing an acoustic wave to be formed in said chamber to excite a selected resonant acoustic mode of said chamber, so that the fluid is compressed in said chamber; and a flow impedance apparatus coupled to said chamber.

24. An acoustic compression system comprising:

a chamber containing a refrigerant, said chamber having rigid end walls with acoustic reflective terminations and having means, including at least an internal wall configuration of said chamber, which provide the harmonic phases and amplitudes such as to synthesize a steady state, non-sinusoidal unshocked waveform in said refrigerant;

a driver coupled to said chamber for mechanically oscillating the entire chamber thus causing an acoustic wave to be formed in said chamber to excite a selected resonant acoustic mode of said chamber, so that the refrigerant is compressed in said chamber; and a flow impedance apparatus coupled to said chamber.

25. A compression-evaporation system comprising:

a chamber containing a refrigerant, said chamber having rigid end walls with acoustic reflective terminations and having means including at least an internal wall configuration of said chamber, which provides the harmonic phases and amplitudes such as to synthesize a non-sinusoidal unshocked waveform in said refrigerant, said chamber having at least one inlet and at least one outlet;

a driver coupled to said chamber for mechanically oscillating the entire chamber thus causing an acoustic wave to be formed in said chamber to excite a selected resonant acoustic mode of said chamber, so that the refrigerant is compressed in said chamber;

a condenser coupled to said at least one outlet of said chamber;

a pressure reduction device coupled to said condenser; and an evaporator coupled to said pressure reduction device and to said at least one inlet of said chamber.

26. A compression-evaporation system as recited in claim 25, wherein said chamber further comprises a first valve positioned in said at least one inlet and a second valve positioned in said at least said one outlet.

27. A method for producing acoustic resonance in a chamber, comprising the steps of:

selecting the shape of said chamber including inner surface dimensions and contour and two end wall dimensions, each end wall being reflective to acoustic energy, said shape selected to provide a desired non-sinusoidal, unshocked waveform when said chamber is driven at a selected resonance mode of said chamber, introducing a fluid into the chamber; and mechanically oscillating the chamber at a frequency of said selected resonant mode.

28. A method for producing acoustic resonance in a chamber, comprising the steps of:

selecting the shape of said chamber including inner surface dimensions and contour and two end wall dimensions, each end wall being reflective to acoustic energy, said shape selected to provide a desired non-sinusoidal, unshocked waveform when said chamber is driven at a selected resonance mode of said chamber, and said shape being selected such that dr/dz is continuous at portions of said chamber inner surface where particle velocities of a fluid within said chamber are sufficiently high so as to otherwise produce substantial turbulence, where r is the radial dimension of said inner surface of said chamber and z is an axial coordinate, introducing said fluid into the chamber; and mechanically oscillating the chamber at a frequency of said selected resonant mode.

29. A method for producing acoustic resonance in a chamber, comprising the steps of:

selecting the shape of said chamber including inner surface dimensions and contour and two end wall dimensions, each end wall being reflective to acoustic energy, said shape selected to provide a desired non-sinusoidal, unshocked waveform when said chamber is driven at a selected resonance mode of said chamber, and said shape being selected such that dr/dz is continuous at portions of said chamber inner surface where particle velocities of a fluid within said chamber are sufficiently high as would otherwise produce substantial turbulence, and $d^2r/dz^2$ is relatively low so as to minimize turbulence resulting from radial fluid accelerations, where r is the radial dimension of said inner surface of said chamber and z is an axial coordinate, introducing said fluid into the chamber; and mechanically oscillating the entire chamber at a frequency of said selected resonant mode.

* * * * *